US009180329B2

(12) United States Patent
Doane

(10) Patent No.: US 9,180,329 B2
(45) Date of Patent: Nov. 10, 2015

(54) EXERCISE BENCH WITH ROTATING TORSO SUPPORT

(71) Applicant: Michael Patrick Doane, Falls Church, VA (US)

(72) Inventor: Michael Patrick Doane, Falls Church, VA (US)

(73) Assignee: Michael Patrick Doane, Falls Church, VA (US)

( * ) Notice: Subject to any disclaimer, the term of this patent is extended or adjusted under 35 U.S.C. 154(b) by 231 days.

(21) Appl. No.: 13/872,109

(22) Filed: Apr. 28, 2013

(65) Prior Publication Data

US 2014/0323277 A1 Oct. 30, 2014

(51) Int. Cl.

| | |
|---|---|
| ***A63B 69/10*** | (2006.01) |
| ***A63B 71/00*** | (2006.01) |
| ***A63B 26/00*** | (2006.01) |
| ***A63B 21/00*** | (2006.01) |
| ***A63B 23/02*** | (2006.01) |
| *A63B 21/068* | (2006.01) |
| *A63B 23/00* | (2006.01) |
| *A63B 69/00* | (2006.01) |

(52) U.S. Cl.

CPC ..... *A63B 21/00047* (2013.01); *A63B 23/0211* (2013.01); *A63B 23/0233* (2013.01); *A63B 69/10* (2013.01); *A63B 21/068* (2013.01); *A63B 2023/003* (2013.01); *A63B 2069/0062* (2013.01); *A63B 2208/0261* (2013.01)

(58) Field of Classification Search

CPC .... A63B 26/003; A63B 26/00; A63B 21/068; A63B 22/0089; A63B 2208/0214; A63B 2208/0247; A63B 23/02; A63B 23/0211; A63B 23/1254; A63B 21/00047; A63B 21/1457; A63B 2225/09; A63B 21/00181; A63B 21/1492; A63B 21/055; A63B 21/1476; A63B 23/0227; A63B 69/10; A63B 21/0083; A63B 21/1434; A63B 22/0605; A63B 22/0041; A63B 23/00; A63B 22/0005; A63B 21/00054; A63B 21/1461; A63B 21/00069; A63B 21/015

USPC ..... 482/140–145, 51, 55–56, 130, 907; 297/195.11, 215.13, 338, 344.18, 408, 297/423.11–423.12

See application file for complete search history.

(56) References Cited

U.S. PATENT DOCUMENTS

| | | | | | |
|---|---|---|---|---|---|
| 5,149,174 | A * | 9/1992 | Charash | 297/423.12 |
| 5,176,603 | A * | 1/1993 | Hundley et al. | 482/140 |
| 5,256,126 | A * | 10/1993 | Grotstein | 482/142 |
| 5,295,728 | A * | 3/1994 | Schaevitz | 297/195.1 |
| 5,401,078 | A * | 3/1995 | Riach | 297/423.11 |
| 5,971,485 | A * | 10/1999 | Clark | 297/423.12 |
| 5,971,902 | A * | 10/1999 | Robertson et al. | 482/142 |
| 6,387,024 | B1 * | 5/2002 | Monti et al. | 482/142 |
| 6,543,853 | B1 * | 4/2003 | Splane, Jr. | 297/423.12 |
| 6,769,736 | B2 * | 8/2004 | Roleder et al. | 297/195.11 |
| 7,128,701 | B1 * | 10/2006 | Ketcham | 482/142 |
| 7,134,989 | B2 * | 11/2006 | Liao | 482/142 |
| 7,144,080 | B2 * | 12/2006 | Lloyd | 297/195.11 |
| 7,311,645 | B1 * | 12/2007 | Lynch et al. | 482/142 |

(Continued)

*Primary Examiner* — Oren Ginsberg
*Assistant Examiner* — Andrew S Lo

(57) ABSTRACT

An exercising apparatus is disclosed having a padded support for a user's hips and all, or a portion of, the user's torso. The padded support is positioned on either a fixed-length, or an adjustable support at approximately hip height and it is angled upward from the floor on which the exercise device is resting at approximately midway between horizontal and vertical, and is capable of side to side arcuate movement along an axis that is located in line with and above the upper surface of the padded support.

7 Claims, 5 Drawing Sheets

Exercise Bench with Telescoping Base Member Isometric View From Rear Right

(56) References Cited

U.S. PATENT DOCUMENTS

| | | | | |
|---|---|---|---|---|
| 7,374,518 | B2 * | 5/2008 | Ratner | 482/136 |
| 7,442,153 | B1 * | 10/2008 | Chasnov | 482/142 |
| 7,591,769 | B1 * | 9/2009 | Benjamin et al. | 482/95 |
| 8,007,414 | B2 * | 8/2011 | Riney et al. | 482/95 |
| 8,062,196 | B1 * | 11/2011 | Khubani | 482/140 |
| 2002/0067060 | A1 * | 6/2002 | Lloyd | 297/195.11 |
| 2002/0101108 | A1 * | 8/2002 | Roleder et al. | 297/423.12 |
| 2002/0132706 | A1 * | 9/2002 | Sleamaker | 482/51 |
| 2003/0040409 | A1 * | 2/2003 | Lindqvist | 482/142 |
| 2004/0070253 | A1 * | 4/2004 | Murphy et al. | 297/423.11 |
| 2006/0100070 | A1 * | 5/2006 | Abdo | 482/121 |
| 2006/0217249 | A1 * | 9/2006 | Webber | 482/142 |
| 2008/0064576 | A1 * | 3/2008 | Tyree | 482/129 |
| 2008/0090710 | A1 * | 4/2008 | Chung | 482/142 |
| 2008/0096743 | A1 * | 4/2008 | Weir et al. | 482/140 |
| 2008/0096744 | A1 * | 4/2008 | Perry | 482/144 |
| 2009/0137372 | A1 * | 5/2009 | Gates | 482/142 |
| 2010/0216616 | A1 * | 8/2010 | Jennings | 482/142 |
| 2011/0039668 | A1 * | 2/2011 | McCall, Jr. | 482/142 |
| 2011/0301002 | A1 * | 12/2011 | Sebastian | 482/140 |
| 2012/0077655 | A1 * | 3/2012 | Wilson | 482/142 |
| 2013/0190149 | A1 * | 7/2013 | Carraway | 482/140 |
| 2014/0066275 | A1 * | 3/2014 | Miller, Jr. | 482/142 |
| 2014/0066276 | A1 * | 3/2014 | Hornback et al. | 482/145 |

* cited by examiner

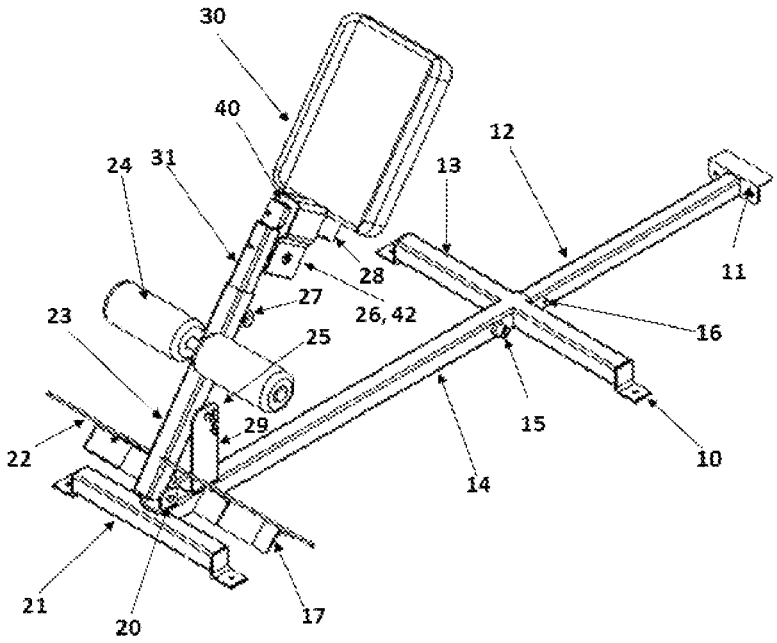
Figure 1 – Exercise Bench with Telescoping Base Member Isometric View From Rear Right

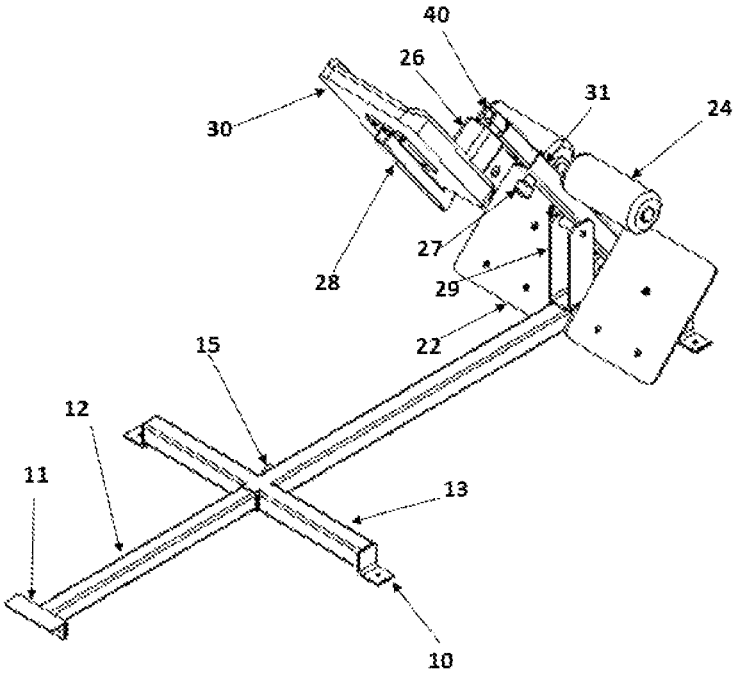
Figure 2– Exercise Bench with Telescoping Base Member Isometric View From Front Left

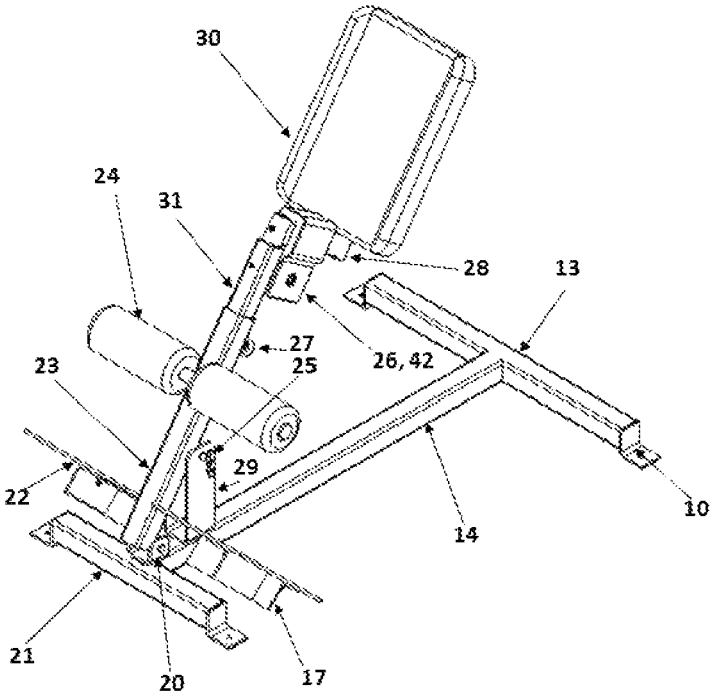
Figure 3 – Exercise Bench with Fixed Base Isometric View From Rear Right

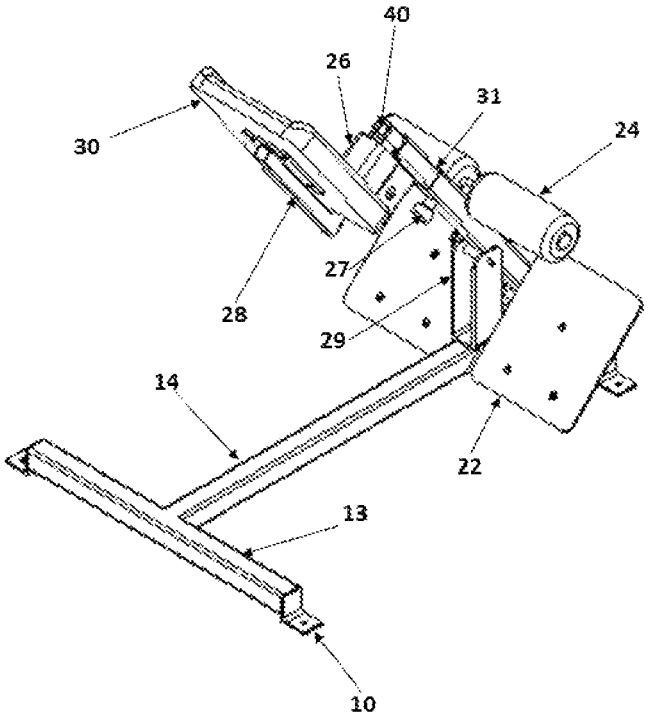
Figure 4 – Exercise Bench with Fixed Base Isometric View From Front Left

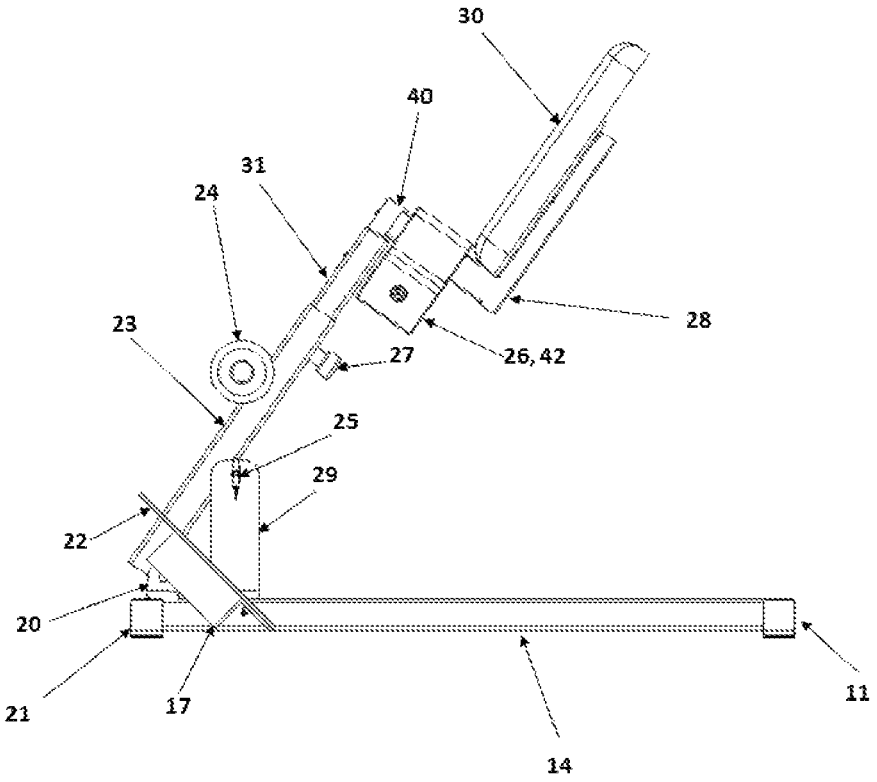
Figure 5 – Exercise Bench with Fixed Base Right Side View

EXERCISE BENCH WITH ROTATING TORSO SUPPORT

References Cited
U.S. Pat. Nos.

| | | |
|---|---|---|
| 2,109,775 | May 1938 | Hudson |
| 3,085,356 | April 1963 | Wayfield |
| 3,140,549 | July 1964 | Wayfield |
| 3,544,103 | December 1970 | Conable |
| 3,791,646 | February 1974 | Marchignoni |
| 4,537,396 | August 1985 | Hooper |
| 4,674,740 | June 1987 | Iams; Splane |
| 4,830,363 | May 1989 | Kennedy |
| 4,844,450 | July 1989 | Rodgers |
| 4,872,668 | October 1989 | Fly; McGillis |
| 5,029,848 | July 1991 | Sleamaker |
| 5,158,513 | October 1992 | Reeves |
| 5,354,251 | October 1994 | Sleamaker |
| 5,376,060 | December 1994 | Murray |
| 5,860,899 | January 1999 | Rassman |
| 5,971,902 | October 1999 | Robertson et al. |
| 7,585,256 | September 2009 | Harbaugh IV et al. |
| 7,601,103 B2 | March 2006 | Chen; Chen |

BACKGROUND OF THE INVENTION

An exercising apparatus should allow the user to strengthen specific muscles used in the sport. For a swimming simulator, the rotation of the body and its positioning relative to the direction of forces exerted should simulate the motions involved in swimming in water. Existing exercise devices, include swim benches which allow some form of rotation of the body, however independent rotation of the upper and lower body portions of the user is not provided by the prior art systems with the exception of the pivotable torso exercise support in U.S. Pat. No. 5,628,632 issued to Doane on May 13, 1997.

Prior art swimming simulator systems require the user to lay horizontally on a bench surface and to pull against a resistance. When said resistance is high, the user's body has a tendency to slide forward on the bench. The user is forced to activate muscles not normally used in swimming in order to hold themselves in place and prevent the body from moving forward relative to the bench. Prior art systems that require the user to lay horizontally on a bench surface also result in a large space requirement for the devices as there must be room for the fully extended body with legs extended horizontally behind the device and hands outstretched in front of the head.

U.S. Pat. No. 4,674,740 issued to lams et al. on Jun. 23, 1987 discloses a swimming trainer which allows for a rocking motion of the body during execution of the stroke. The user's torso and hips in the lam device lay horizontally on a common bench and the entire frame moves as one, causing the entire body to rock. A drawback to this design is that the lower body must rotate with the upper body in the same direction and to the same degree.

Another related swimming machine uses two independent supports for the upper and lower body. In U.S. Pat. No. 5,158,513, issued to Reeves on Oct. 27, 1992, the user's body is supported in a generally horizontal position so the user can pull against hand paddles which activate a resistance mechanism. However, the support for the upper body which allows for chest rotation forces the chest out of line with the head because its center of rotation is below the body. A proper stroke technique requires that the body should rotate about a center axis which is approximately in line with the spine of the body.

U.S. Pat. No. 5,354,251, issued to Sleamaker, discloses a swimming machine that uses a bench support for the user's body where the bench tilts from side to side. U.S. Pat. No. 7,585,256, issued to Harbaugh IV et al., also allows the bench to pivot on an axis directly underneath the body support bench. Each of these allows for movement and rotation of the body from side to side in order for the user to lean into the stroke. However, this type of movement causes a user to weave from left to right while he/she progresses through the water. Thus, the swimmer would be traveling a greater distance because they would not be moving in a straight line.

U.S. Pat. No. 5,971,902, issued to Robertson et al., discloses a lumbar extension machine that supports the user in a manner very similar to the equilibrium position, or the resting position, of the present invention, however its support pad is fixed in one position and does not allow the user to freely rotate their torso.

Other exercising devices such as that of U.S. Pat. Nos. 4,830,363 and 3,791,646 are known, but the prior art does not provide for independent movement of the user's upper and lower body and where the torso or upper body portion is permitted to rotate with a center of rotation that is located above the bench and approximately in line with most users' spines. The prior art also does not allow the user to operate the device in a leaning position that saves horizontal space and prevents unwanted movement of the user's body relative to the device.

SUMMARY OF THE INVENTION

The present invention relates generally to the field of exercising apparatus for athletic activities, where the torso of a user does not actually move from side to side, but rotates about a center of rotation axis approximately in line with a user's spine. The present invention can be used as a swimming simulator or on other exercising equipment to allow for greater mobility and proper technique when performing various exercises. When used as part of a swimming simulator, the apparatus allows the user to perform technically correct strokes with proper body positioning and strengthen only those muscles used when swimming in water. When used in conjunction with, or as an integral part of, other existing exercising equipment, the swinging bench of the present invention allows for independent mobility of the upper and lower body so that proper form can be employed to isolate sport-specific muscles while moving against the resistance offered by the exercise equipment.

One aspect of the present invention is to allow the user to properly simulate the motions involved in a sport for which the exercise machine has been designed.

Another aspect of the present invention is to provide body support which permits proper body motion on a waterless swim training exercise machine that may include a resistance system for the hands, thereby permitting natural side-to side rolling motion of the torso that the swimmer experiences when applying a stroke using alternate hands sequentially as in the freestyle stroke. This rotational motion is about a center axis approximately in line with the spine. This rotational movement of the chest must be independent of the motion, or lack thereof, of the user's lower body. The user's feet rest on a platform that is connected to the device frame near the ground. Padded supports situated behind the user's calves prevent the user's feet from sliding backwards on the platform and provide additional stability to allow the user to easily rotate their upper body and to keep their torso properly positioned on the padded bench swing.

Still another aspect of the present invention is to allow the user's body to rotate while in a forward leaning position, thereby permitting their bodyweight to keep them from moving relative to the exercising device. The user must be able to exert high forces at rapid speeds against a resistance mechanism they pull using their hands without strapping or belting themselves to the device.

BRIEF DESCRIPTION OF THE DRAWINGS

FIG. 1—Is an isometric view from the rear right side of the Exercise Bench with a base frame that includes the telescoping member for securing the bench to another object.

FIG. 2—Is an isometric view from the front left side of the Exercise Bench with a base frame that includes the telescoping member.

FIG. 3—Is an isometric view from the rear right side of the Exercise Bench with a fixed base frame.

FIG. 4—Is an isometric view from the front left side of the Exercise Bench with a fixed base frame.

FIG. 5—Is a right side elevational view of the Exercise Bench with a fixed base frame.

DETAILED DESCRIPTION OF THE INVENTION

In the present invention a padded bench on a swing frame is provided to support a user's torso in a forward leaning position while allowing them to rotate the padded bench and their torso from side to side about an axis that is primarily in-line with their spine, thus simulating the rotational movement of some exercises, and more specifically during swimming. The padded bench and swing frame must move independently from the frame that holds it and the base that supports the user's feet and legs.

The invention will now be discussed with reference to FIGS. 1 through 5. The device includes a base frame that rests on the ground and, in a preferred embodiment, includes four feet, 10, that keep most of the frame off the ground and allow the feet to be bolted to the floor to prevent movement. In another preferred embodiment said base frame includes a telescoping member, 12, that moves relative to the base frame and is sized to fit inside the base frame's longitudinal member, 14. The telescoping member, 14, includes adjustment holes, 16, at specific intervals along its length. A spring-based plunger pin, 15, is affixed to the side of the base frame longitudinal member, 14. The plunger pin extends through the base frame and into one of the holes, 16, in the side of the telescoping member, 12, to prevent movement of the telescoping member after is has been adjusted to the desired position. The spring-based plunger pin, 15, allows a user to disengage the plunger's pin from a hole, 16, in the side of the telescoping member, 12, to allow for repositioning of the telescoping member. In a preferred embodiment said telescoping member includes an end mounting plate, 11, that includes bolt holes allowing the device to be fixed to a wall, or to a resistance device that is positioned in front of the invention, to prevent movement of the invention relative to the ground, the wall, and/or the resistance device. FIGS. 1 & 2 show the invention with a base that includes the telescoping member, 12, and FIGS. 3-5 show the invention with a base that does not include the telescoping member.

Adjustable support, 23, extends upward from the device base at an angle between 40° and 70° from horizontal. In a preferred embodiment the adjustable support extends upward at a 55° angle and includes a means whereby it can be lowered to take up less room for storage. In a preferred embodiment the adjustable support, 23, is secured to the base through rear bracket, 20, and forward bracket, 29. Forward bracket, 29, includes a quick release pin, 25, that can be removed to lower the adjustable support, 23, and portion of the invention that it supports, for more compact storage. A telescoping member, 31, is positioned inside of and extends from the top of the adjustable support, 23. It is within the spirit of the invention for the adjustable support, 23, and telescoping member, 31, to be replaced with a single fixed length support member. Adjustable support, 23, and telescoping member, 31, rise from the base and are oriented in the same plane as the invention's base longitudinal member, 14. The adjustable support, 23, provides a means for telescoping member, 31, to be extended upwards using a spring-based plunger pin, 27, secured to the adjustable support, 23, that engages with holes on the underside of the telescoping member, 31. Two bearings or bushings, 41, not shown, are positioned inside the top end of the telescoping member, 31. A shaft, 40, is supported by and passes through bearings, 41, and extends upward past the end of the telescoping member, 31. A bench pad support frame, 28, mounts onto the end of shaft, 40, and is secured to it. The shaft, 40, and the bench pad support frame, 28, freely rotate inside the bearings, 41. The bench pad support frame, 28, extends predominantly downward and perpendicular to the shaft, 40, and then bends, in a preferred embodiment at a 90° angle to continue upward at the same angle as the adjustable support, 23, telescoping member, 31, and shaft, 40. A padded torso support bench, 30, is mounted onto the portion of the bench pad support frame, 28, that is parallel to adjustable support 23, telescoping member 31, and shaft, 40. The padded torso support bench, 30, and frame, 28, are free to rotate with shaft, 40 and, in a preferred embodiment, trace a cylindrical path, with a central axis in-line with the center of shaft, 40. In an alternate embodiment the torso support bench, 30, may be angled slightly up or down from the angle of adjustable support, 23, telescoping member, 31, and shaft, 40 and the path traced by the torso support bench, 30, will be conical. The top of the padded torso support bench, 30, is positioned such that an average physically fit user's spine will be in-line with the axis of shaft, 40, when their groin and stomach are resting against the padded torso support bench, 30. In a preferred embodiment, the distance between the top of padded torso support bench, 30, and the central axis of shaft, 40, is six inches and it is within the spirit of the invention for this distance to be adjustable. The weight of the padded torso support bench, 30, and frame, 28, ensures it always returns to an equilibrium position where the torso support frame, 28, is aligned with the longitudinal member, 14, of the device base and the top and bottom edges of the torso support bench, 30, are parallel to the floor. It is within the spirit of the invention for a spring to be attached to the device frame and to the torso support frame to help return the torso support bench to an equilibrium position after it is rotated away from the equilibrium position. It is also within the spirit of the invention for a resisting device, such as, a hydraulic damper, to be attached between the torso support and the device frame to force the user to expend more effort when rotating the bench.

An inner thigh pad, 26, is attached to the pad mount, 42, which is attached to the torso support frame, 28, at the back side of the portion of the torso support frame that is perpendicular to shaft, 40. The inner thigh pad wraps around the torso support frame, 28, and attaches to the pad mount, 42. The inner thigh pad, 26, covers both sides of the pad mount, 42. The inner thigh pad and mount are situated between the user's inner thighs during proper use of the device, and allow the user to stay properly positioned on the torso support bench when rotating from side to side.

Two calf support pads, 24, extend outward on both sides from adjustable support, 23, where they press against the back of the user's calves and help to support the user's lower legs and thereby enable controlled rotation of their torso. In a preferred embodiment two foot plates, 22, are attached to each side of the base's foot plate mounts, 17, which are attached to longitudinal member, 14, near the back portion of the base, 21. The foot plates, 22, are angled upward towards and are approximately perpendicular to adjustable support, 23.

When the user is properly positioned on the device one foot will be on each of the two foot plates, 22, with their heels off the ground and closest to the rear of the base, 21. Their toes will point forward towards the transverse member, 13, at the front of the base. The user's legs will be forward of the calf support pads, 24, with the back of the user's calves touching the pads. The user's legs will straddle the inner thigh support pad, 26, with their torso pressed against the padded torso support bench, 30. In a preferred embodiment the torso support bench will be sized so that the user's groin and stomach rest against it while their chest extends past it. This embodiment allows for the chest and shoulders to be rotated more than the lower torso and the corresponding device portion that supports the lower torso. It is also within the spirit of the invention for the torso support bench to be long enough to support the user's entire torso and allow the user to lean their head against the padding. The longer support pad allows novice users to develop strength and coordination while the shorter torso support bench is for more advanced users.

To accommodate different heights of users, spring-based plunger pin, 27, can be disengaged from the holes in the bottom side of telescoping member, 31, so the telescoping member, 31, can be moved up or down thereby raising the torso support bench pad and frame to the desired height.

Having described the invention, what is claimed is:

1. An exercising apparatus comprising:

a base that rests on a floor;

a support member attached to a rear portion of said base and extends up from the base at an angle that is less than 90 degrees vertical, the support member having a length defining a longitudinal axis that extends between a first end and a second end of the support member;

a padded bench and bench frame for supporting an user torso coupled to one end of the support member and spaced a distance away from the longitudinal axis of the support member, wherein the padded bench and bench frame is capable of rotation about the longitudinal axis of the support member;

one or two foot plates attached to the base at a bottom of the support member for the user's feet to be positioned on; and two padded leg supports attached to and extending from the support member, at a height above the foot plate and below the padded bench.

2. The exercising apparatus according to claim 1, wherein the support member further comprises a telescoping member for adjusting the length of the support member.

3. The exercising apparatus according to claim 1, further comprising a pin for adjusting, up or down, the angle between the support member and the base.

4. The exercising apparatus according to claim 1, wherein weight can be added to the padded bench, or the bench frame, to provide resistance to rotation.

5. The exercising apparatus according to claim 1, wherein the padded bench and bench frame is sized to support the user's groin, stomach and chest.

6. The exercising apparatus according to claim 1, wherein the padded bench and bench frame is sized to support the user's groin, stomach, chest, and head.

7. The exercising apparatus according to claim 1, wherein said base includes an adjustable telescoping member for mounting to a wall or resistance device.

* * * * *